US005573243A

United States Patent [19]

Bartosik

[11] Patent Number: 5,573,243

[45] Date of Patent: Nov. 12, 1996

[54] WATER DRIVEN ROTATING FIGURINE AMUSEMENT GAMES

[76] Inventor: Dennis Bartosik, 5705 Jason Lee Pl., Sarasota, Fla. 34233

[21] Appl. No.: 521,976

[22] Filed: Aug. 31, 1995

Related U.S. Application Data

[63] Continuation-in-part of Ser. No. 339,836, Nov. 15, 1994, Pat. No. 5,480,148.

[51] Int. Cl.[6] ..... A63F 9/14

[52] U.S. Cl. ..... 463/60; 273/349; 273/387; 463/58

[58] Field of Search ..... 273/86 R, 86 B, 273/86 F, 348, 349, 387

[56] References Cited

U.S. PATENT DOCUMENTS

| | | | |
|---|---|---|---|
| 836,681 | 11/1906 | Gilman | 273/86 F |
| 1,392,764 | 10/1921 | Higuchi | 273/86 G |
| 1,441,404 | 1/1923 | Czerny . | |
| 1,499,875 | 7/1924 | Rosenheim . | |
| 1,523,795 | 4/1925 | Foams . | |
| 1,749,689 | 3/1930 | Baum | 273/387 |
| 2,034,324 | 3/1936 | Brady | 273/86 G |
| 2,732,210 | 1/1956 | Heide | 273/86 G |
| 3,336,030 | 8/1967 | Martell et al. | 273/349 |
| 3,342,492 | 9/1967 | Barrett | 273/86 R X |
| 3,362,713 | 1/1968 | Miller | 273/349 |
| 3,411,783 | 11/1968 | Montagna | 273/86 |
| 3,572,712 | 3/1971 | Vick | 273/86 F |
| 3,645,529 | 2/1972 | Andrews | 273/403 |
| 3,781,011 | 12/1973 | Barlow | 273/86 G |
| 4,838,550 | 6/1989 | Walker et al. | 273/86 R |
| 5,118,320 | 6/1992 | Miller | 446/288 |
| 5,439,230 | 8/1995 | Mendes, Jr. | 273/349 |
| 5,480,148 | 1/1996 | Bartosik | 273/86 B |

*Primary Examiner*—William H. Grieb
*Attorney, Agent, or Firm*—Franklin J. Cona, P.E.

[57] ABSTRACT

A water activated rotatable column game system for fun and amusement and prizes is disclosed. The system comprises a game housing having an open rear face and open side faces and an enclosed top roof and an enclosed bottom floor and an open front face for the people to participate and observe the progress of the game. A plurality of rotatable columns and figurines are disposed within the game housing in an upstanding parallel orientation, each rotatable column being dedicated to travel rotatably from a start line to a finish bumper. A plurality of game consoles are disposed adjacent to the game housing and control the rotatable columns. A plurality of motor means are disposed in the game housing. Each motor means is electrically coupled to one rotatable column for moving the rotatable column. Each console has a switch means disposed therein and further being in an electric circuit therebetween one of the consoles and one of the rotatable columns for moving the rotatable column when in a closed status and halting the rotatable column when in an open status. A second plurality of switch means are disposed in the game housing at each finish bumper and further being in electric circuit communication therebetween each motor means for illuminating the winning finish bumper.

17 Claims, 18 Drawing Sheets

WATER DRIVEN ROTATING FIGURINE AMUSEMENT GAMES

This application is a Continuation-In-Part application of application Ser. No. 08/339,836, filed Nov. 15, 1994, now U.S. Pat. No. 5,480,148 issued Jan. 2, 1996.

BACKGROUND OF THE INVENTION

1. Field of the Invention

The present invention relates to water driven amusement games, and in particular to a competitive arcade game using a plurality of rotating figurines.

2. Description of the Background Art

Throughout the United States steps are being taken to improve competitive arcade amusement games having a reasonable level of difficulty for people having moderate dexterity and skill for retaining the interest of the participants during the game.

U.S. Pat. No. 1,441,404 issued to Czerny discloses a roller coaster game having a target to initiate movement of a vehicle on the roller coaster.

U.S. Pat. No. 2,034,324 issued to Brady discloses a game having a projectile means, target means to receive the projectile means, and figures which move in response to the projectile impacting on the target means.

U.S. Pat. No. 3,781,011 issued to Barlow discloses a game having a projectile means, target means to receive the projectile means, and figures which move in response to the projectile impacting on the target means.

U.S. Pat. No. 2,732,210 issued to Heide discloses an amusement racing game wherein projectile balls roll down one of several chutes having electrical tripping circuits within each chute to propel a figure, usually a horse, along a track.

U.S. Pat. No. 1,533,795 issued to Foans discloses an arcade racing game wherein a projectile element physically impacts and moves the impacted figure along the raceway.

U.S. Pat. No. 1,499,875 issued to Rosenheim discloses an arcade racing game wherein a projectile element physically impacts and moves the impacted figure along the raceway.

U.S. Pat. No. 3,411,783 issued to Montagna discloses a roller coaster game.

U.S. Pat. No. 5,118,320 issued to Miller also discloses a roller coaster game.

U.S. Pat. No. 3,645,529 issued to Andrews discloses a target game having an electronic basis for moving electronic images on a screen over a game board.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore, it is an object of the present invention to provide a new and improved water driven competitive game that can be enjoyed by participants of all ages.

It is a still further object of the invention to provide a water driven competitive game that rewards accuracy with a prize for propelling the rotatable columns upwardly.

It is a still further object of the invention to provide an amusement game that will be rust and corrosion resistant for the long life of the system as it is moved from place to place.

It is yet another object of the invention to provide a console with the actuator element under control of the contestant and a visual target in the rearward portion of the console that is adapted to be struck by the actuator element, and in particular a water driven actuator element.

It is yet another object of the invention to provide a visual graphic element that indicates to the contestant his relative success vis-a-vis the other contestants in moving their respective visual graphic element upwards towards the finish bumper before the other contestants.

It is yet another object of the invention to provide a system that can be transported easily from place to place on a standard trailer frame.

It is one more object of the invention to provide a system that can be permanently installed in a facility such as a casino or the like.

A final object of this invention to be specifically enumerated herein is to provide a water driven competitive game in accordance with the proceeding objects and which will conform to conventional forms of manufacture, be of simple construction and easy to use so as to provide a device that would be economically feasible, long lasting and relatively trouble free in operation.

Although there have been many inventions related to water driven competitive games none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a water activated rotating figurines competitive game for use by people for fun and amusement and prizes. The system comprises a game housing having an open rear and open side faces and an enclosed top roof and an enclosed bottom floor and an open front face for the people to participate in the game and observe the progress of the game. A plurality of rotatable columns and a plurality of figurines are disposed within the game housing in an upstanding parallel orientation. Each rotatable column is dedicated to travel rotatably from a start line toward a finish bumper. The rotatable columns are controlled by a plurality of game consoles that are disposed adjacent to the game housing and outside the front face. Each game console activates and controls the travel of one of the rotatable columns from the start line to the finish bumper.

A plurality of motor means are disposed in the game housing and adjacent to the rotatable columns. Each motor means is electrically coupled to one rotatable column and moves the rotatable column over upwardly. A plurality of switch means are interconnected in an electric circuit therebetween one of the consoles and one of the rotatable columns and move the rotatable column when in a closed status and halt the rotatable column when in an open status.

A second plurality of switch means are interconnected in an electric circuit therebetween the finish bumpers and a pop-up winner indicator disposed rearwardly on one of the game consoles. The second switch means illuminates the finish bumper when a winning rotatable column reaches the finish bumper.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
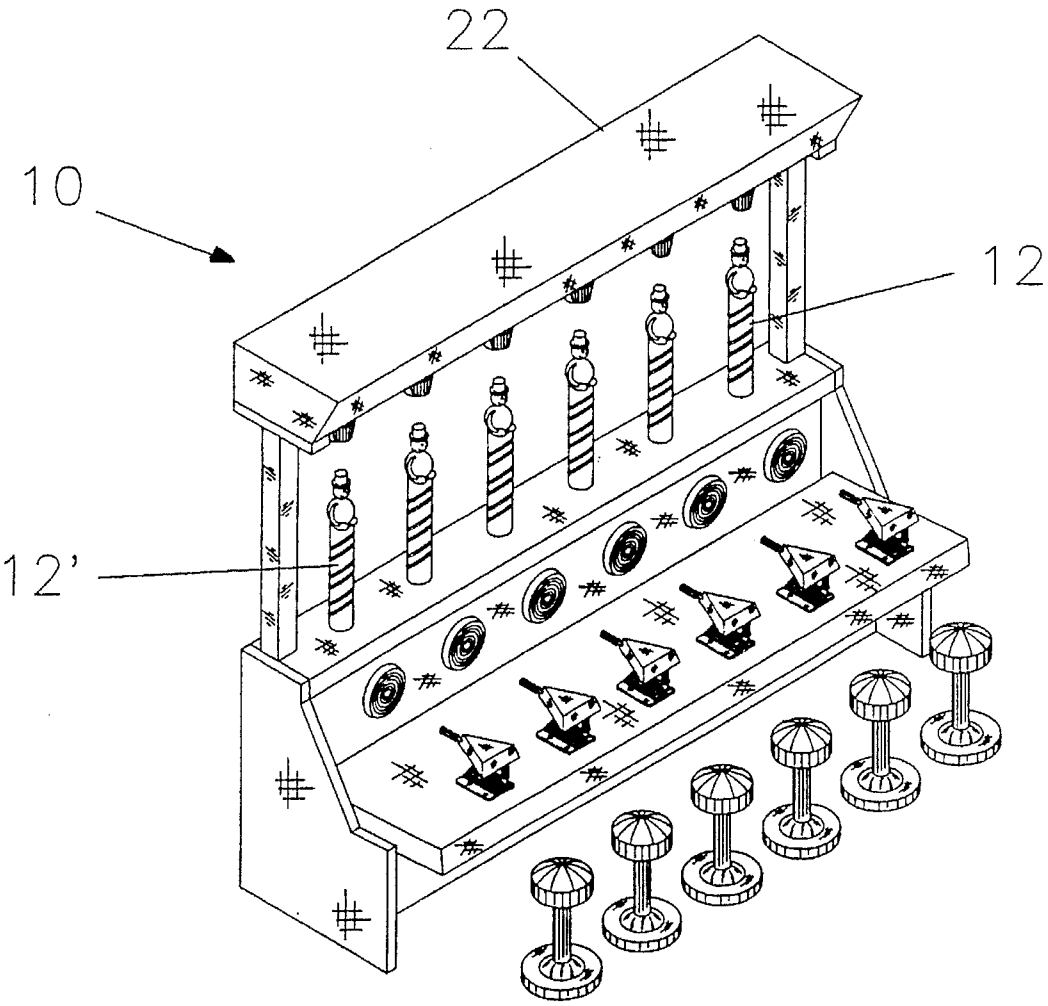
FIG. 1 is a perspective illustration of the single file version of the invention.
Figure 2:
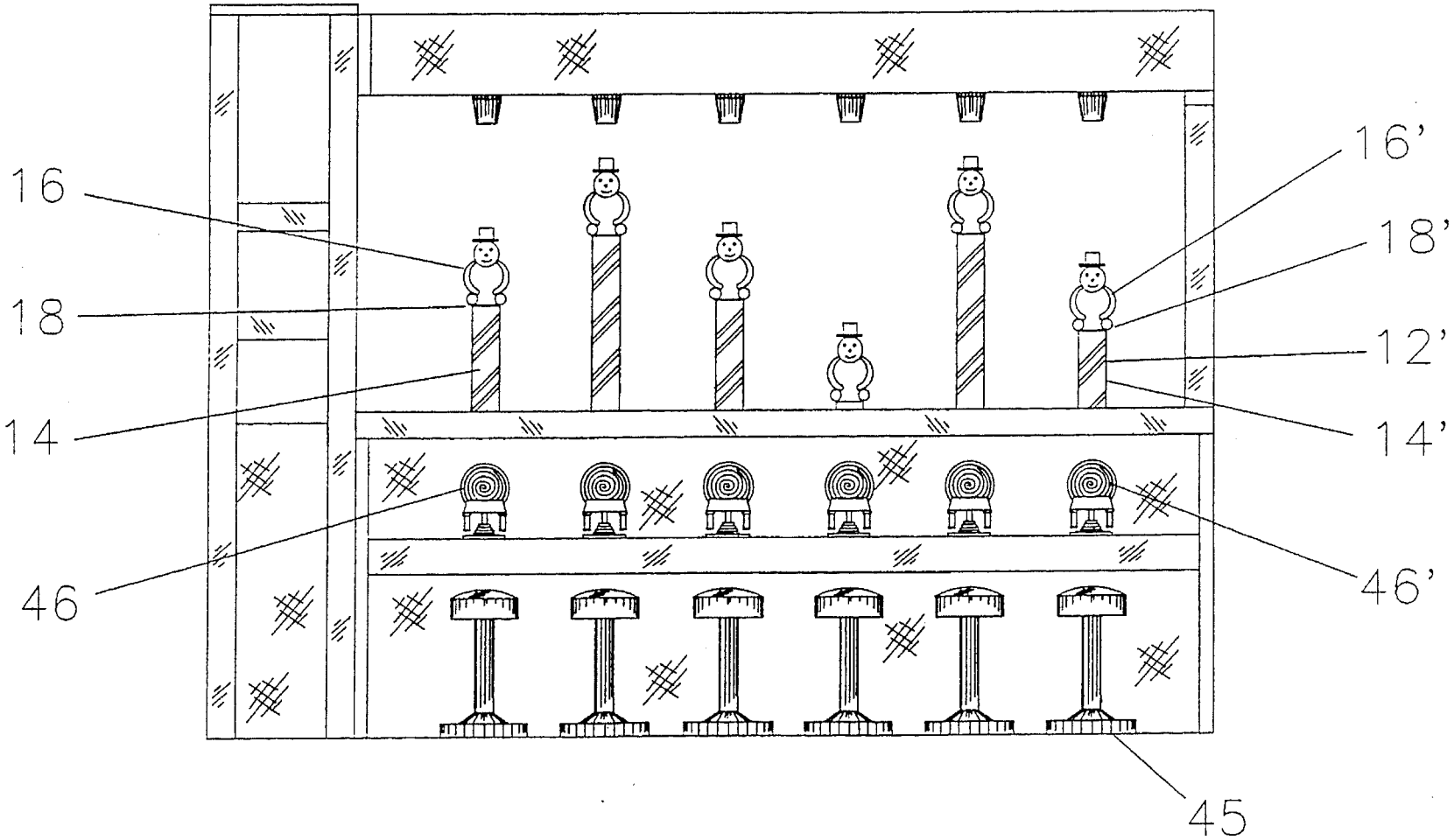
FIG. 2 is a front elevation view of the invention as disclosed in FIG. 1 showing the columns having the oblique striping and the rotating figurines on a top surface thereof, the finish bumper disposed thereabove each rotating figurine, the target element and the actuator element disposed therebelow the rotating columns.
Figure 3:
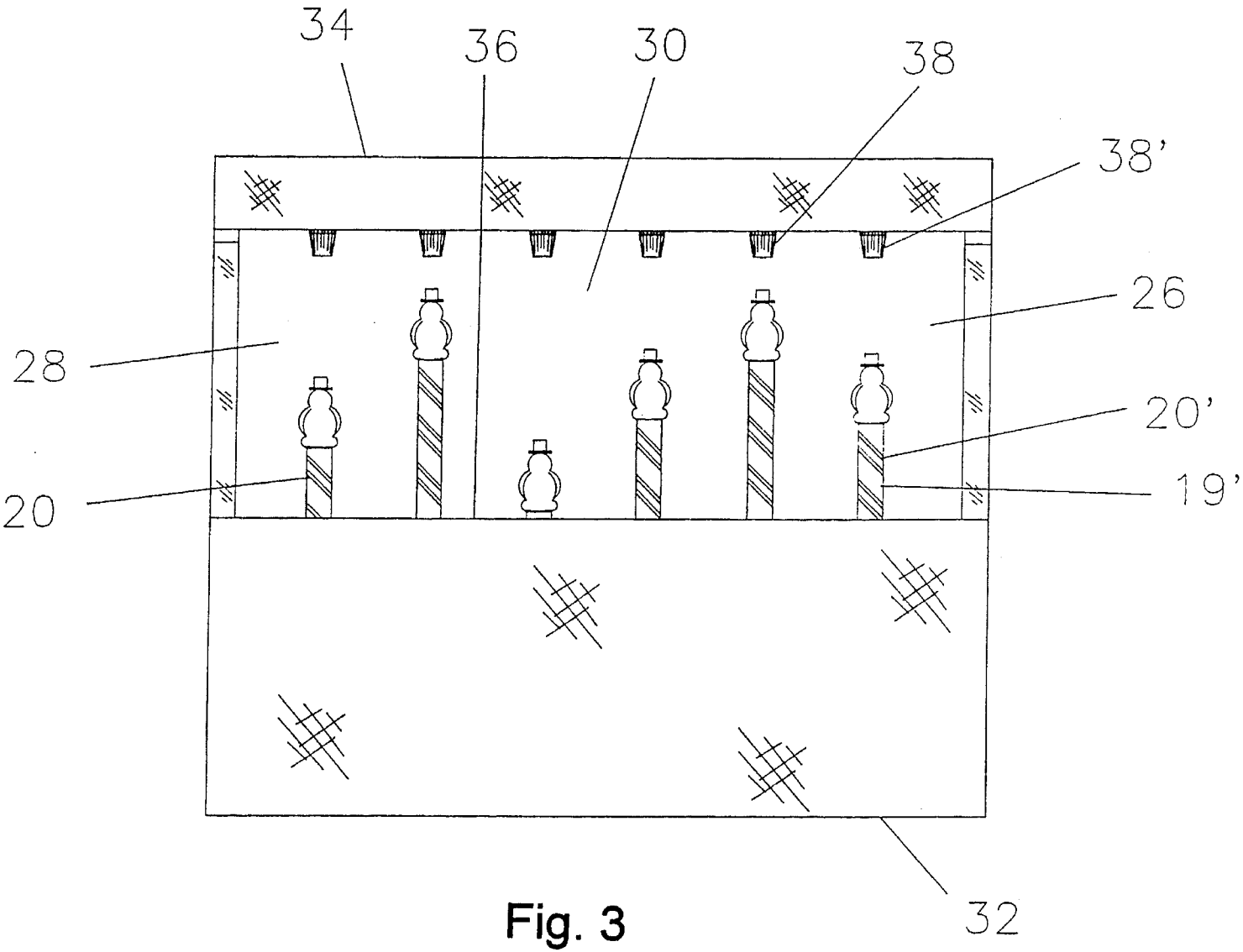
FIG. 3 is a rear elevation view of the invention as disclosed in FIG. 1.

The invention 10 comprises a plurality of rotating movable visual graphic elements, as best seen in FIGS. 1 and 2, namely a plurality of rotatable columns 12, 12'. The invention 10 is intended for the amusement of the participants at county fairs and other community fund raising activities for competitive game between contestants.

The invention 10 comprises three primary components. The first primary component is the visual graphic element 12, 12' which in the preferred embodiment is the individual rotatable column 14, 14'. Each rotatable column 14 is adapted to receive a figurine 16' on a top side 18, as best seen in FIG. 2, and has an outer shell 19 having a plurality of stripes 20 colored to differentiate between the plurality of visual graphic elements 12, 12'.

Figure 4:
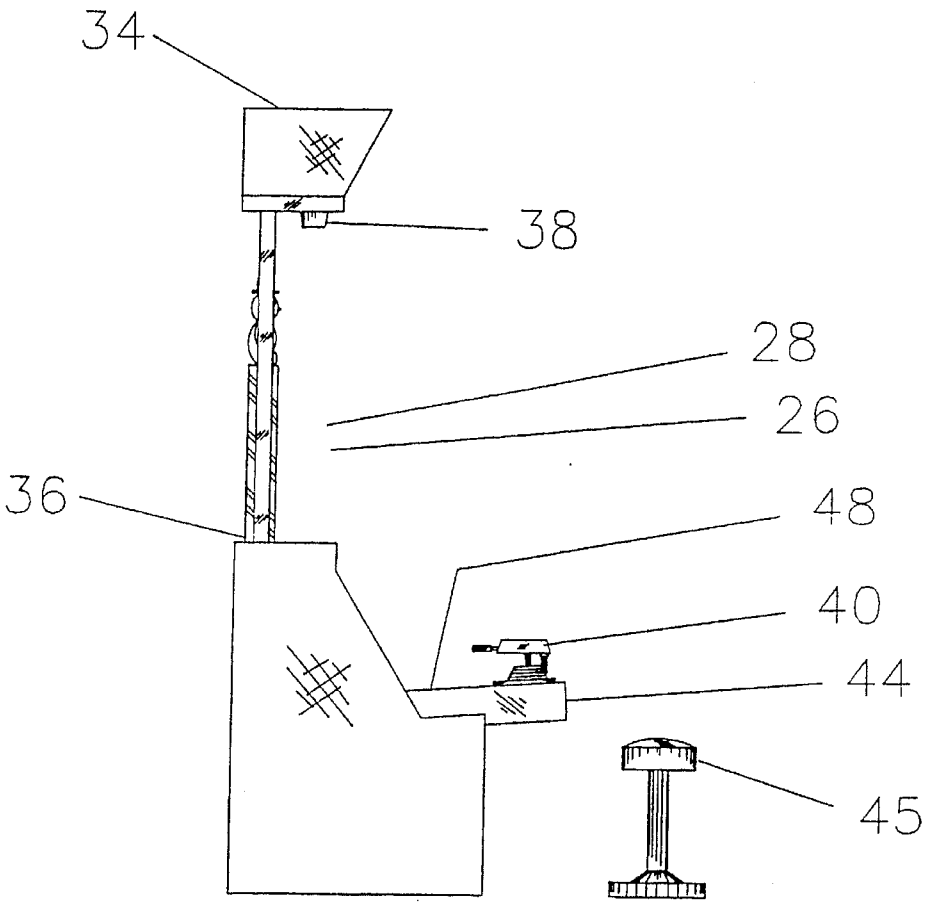
FIG. 4 is a left side view of the invention as disclosed in FIG. 1 disclosing the actuator element and a seat for the contestant, the right side view being identical.
Figure 5:
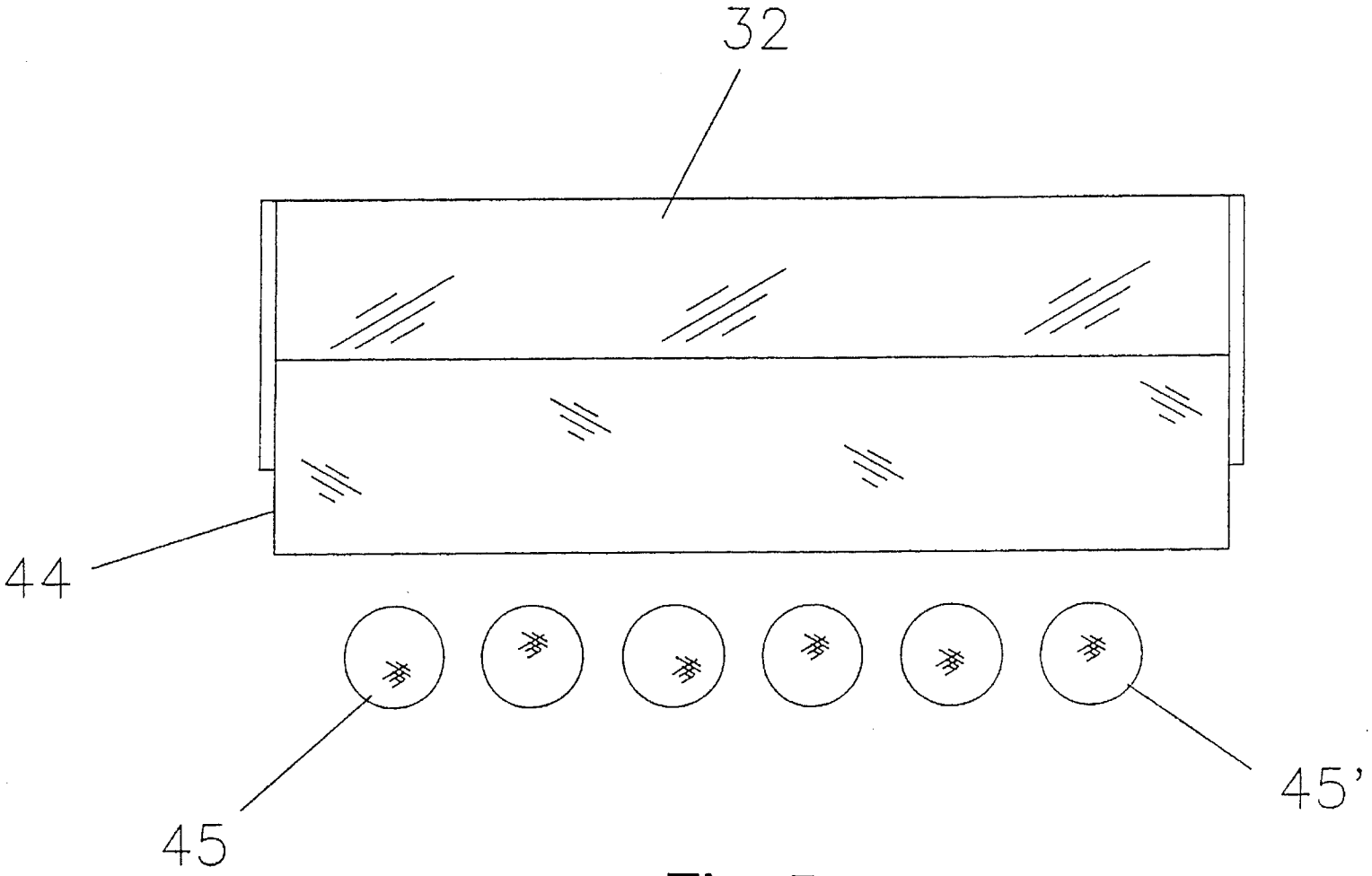
FIG. 5 is a bottom plan view of the invention as disclosed in FIG. 1.
Figure 6:
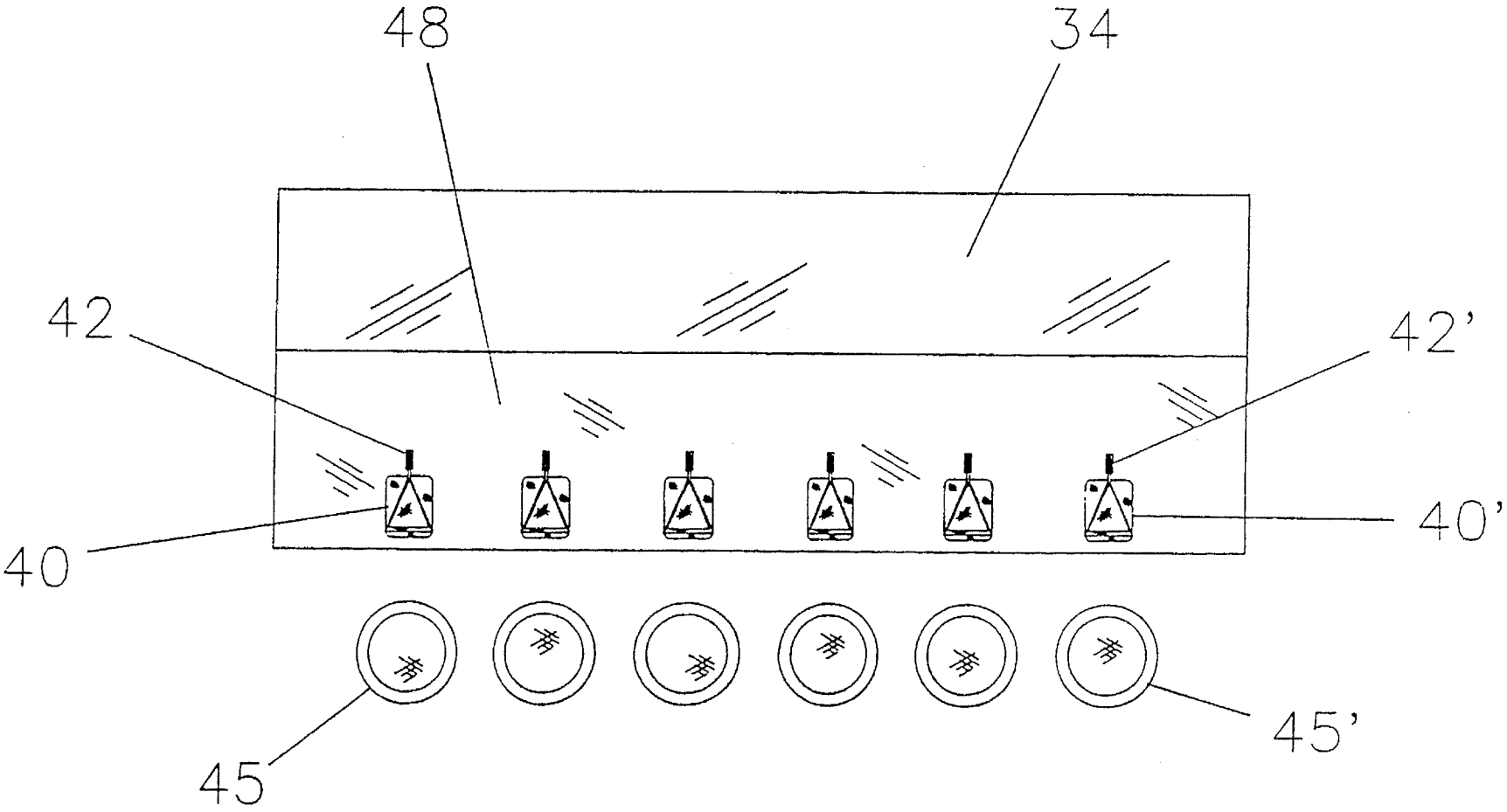
FIG. 6 is a top plan view of the invention as disclosed in FIG. 1 showing the plurality of actuator elements.

The visual graphic elements 12, 12' and the figurines 16, 16' are recessed within a game housing 22. The game housing 22 has an open front face 24 with open sides 26, 28 and open rear face 30 and a floor 32 and an enclosed rooftop 34, as best seen in FIG. 4, that house the plurality of visual graphic elements 12, 12'. The visual graphic elements 12, 12' and the columns 14, 14' are disposed within the game housing 22 in an upstanding parallel orientation. Each figurine 16, 16' is restricted to traveling upwardly from a start line 36 to a finish bumper 38, 38'.

The second primary component is an actuator element 40. In the preferred embodiment, the actuator element 40 is a pressurized water gun 42 for the contestant to aim and operate. The water gun 42 is mounted in a game console 44 which is disposed adjacent to the game housing 22 outside of the front face 24 as best seen in FIG. 4. A seat 45, 45' is provided for each contestant.

The third primary component is a target element 46, 46'. When the contestant strikes the target element 46, the visual graphic element 12 move rotatably upwards towards the finish bumper 38. By striking the target element 46 with intermittent pulses of water, the visual graphic element 12 (the rotatable column) will move rapidly towards the finish bumper 38. Of course, the first contestant to move his or her figurine 16 to the finish bumper 38, wins the contest and an appropriate prize.

Other forms of actuators are also possible. For example, a ball throwing apparatus (non-illustrated) can be utilized as a substitute for the water gun 42 apparatus. That is, by throwing balls at the target 46 rapidly and successfully, the visual graphic element 12 will be moved towards the finish bumper 38 and results in a victory for the person with the most accurate throwing arm. In addition to the above two described actuator elements, a laser actuated aiming device (non-illustrated) that emits energy can also be used, but that is less preferred than the water gun 42 or the ball derby actuation.

The contestants are separated from the visual graphic element 12 and the target element 46 by a platform 48 as best seen in FIG. 4. The water gun 42 is mounted on the platform 48. The contestants lean on the platform 48 to assist them in steadying their aim when using the water gun 42. The distance between the platform 48 and the target element 46 can be increased to increase the degree of difficulty. For example, if the audience is comprised of preteen youngsters, the platform 48 can be moved closer to the target element 46. Alternatively, if the contestants are teenagers or young adults, the platform 48 can be moved further from the target element 46 to increase the degree of difficulty.

Figure 7:
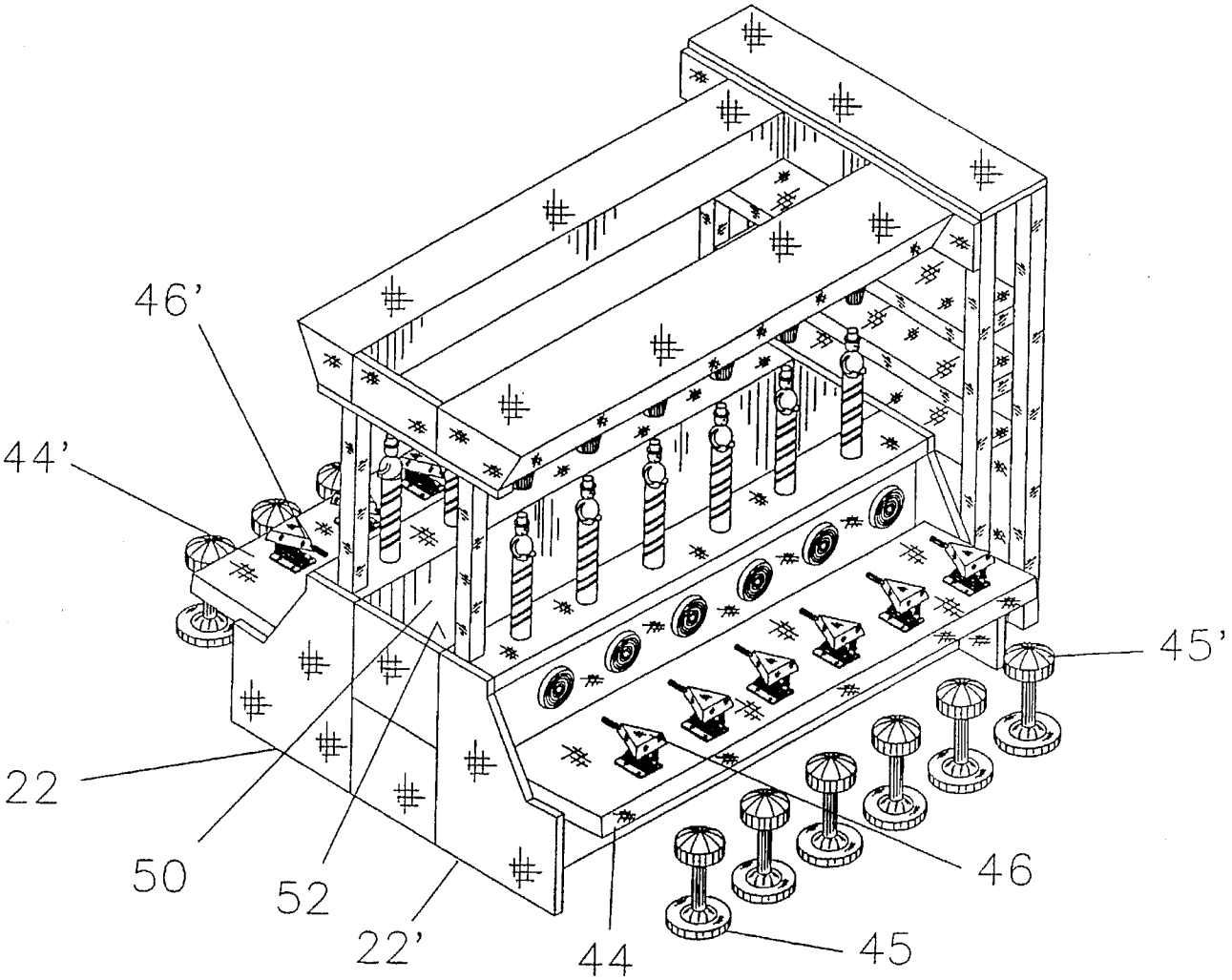
FIG. 7 is a perspective illustration of the double file embodiment of the invention.
Figure 8:
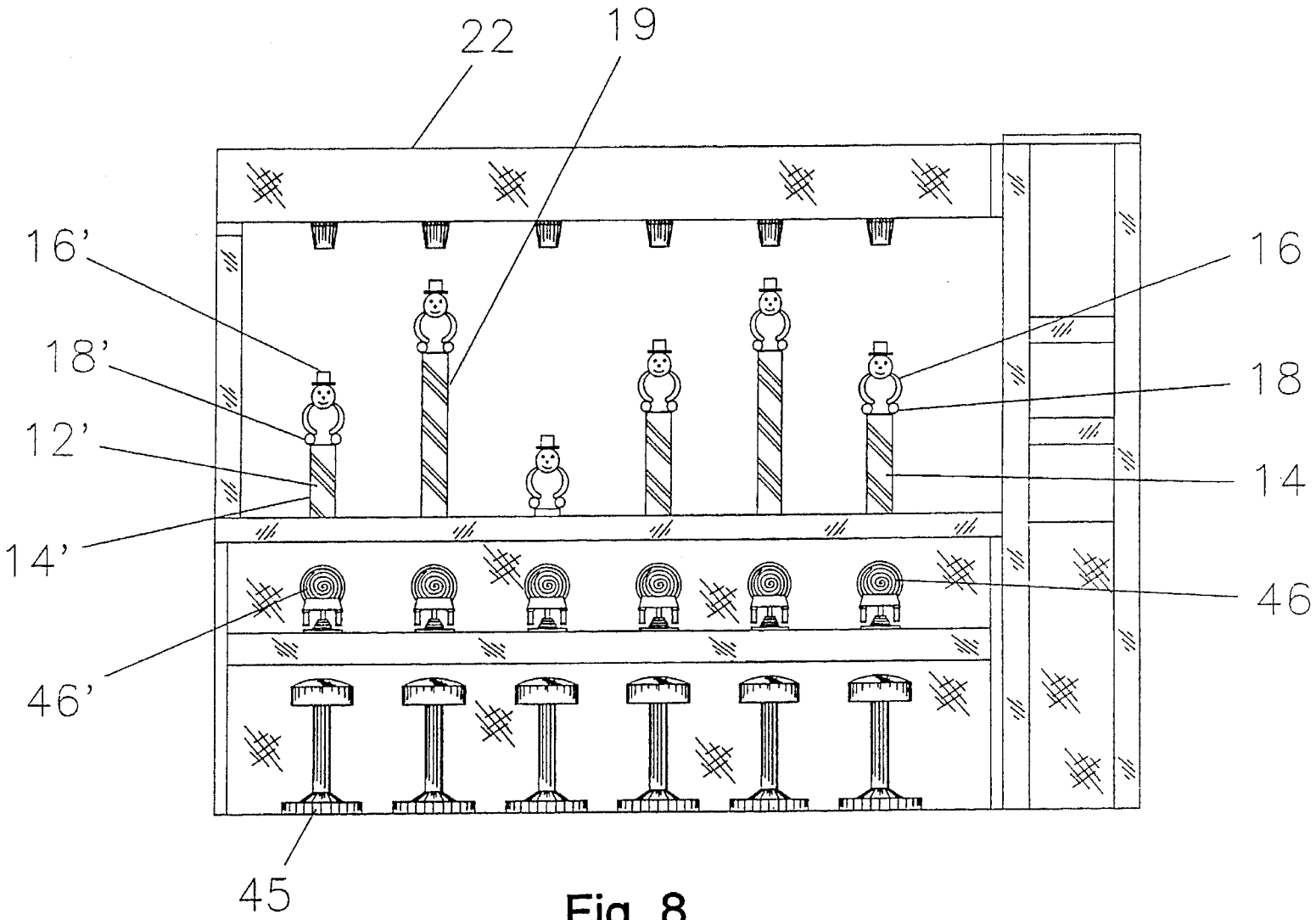
FIG. 8 is a front elevation view of the invention as disclosed in FIG. 7 further disclosing a prize storage display area on a rightmost end.
Figure 9:
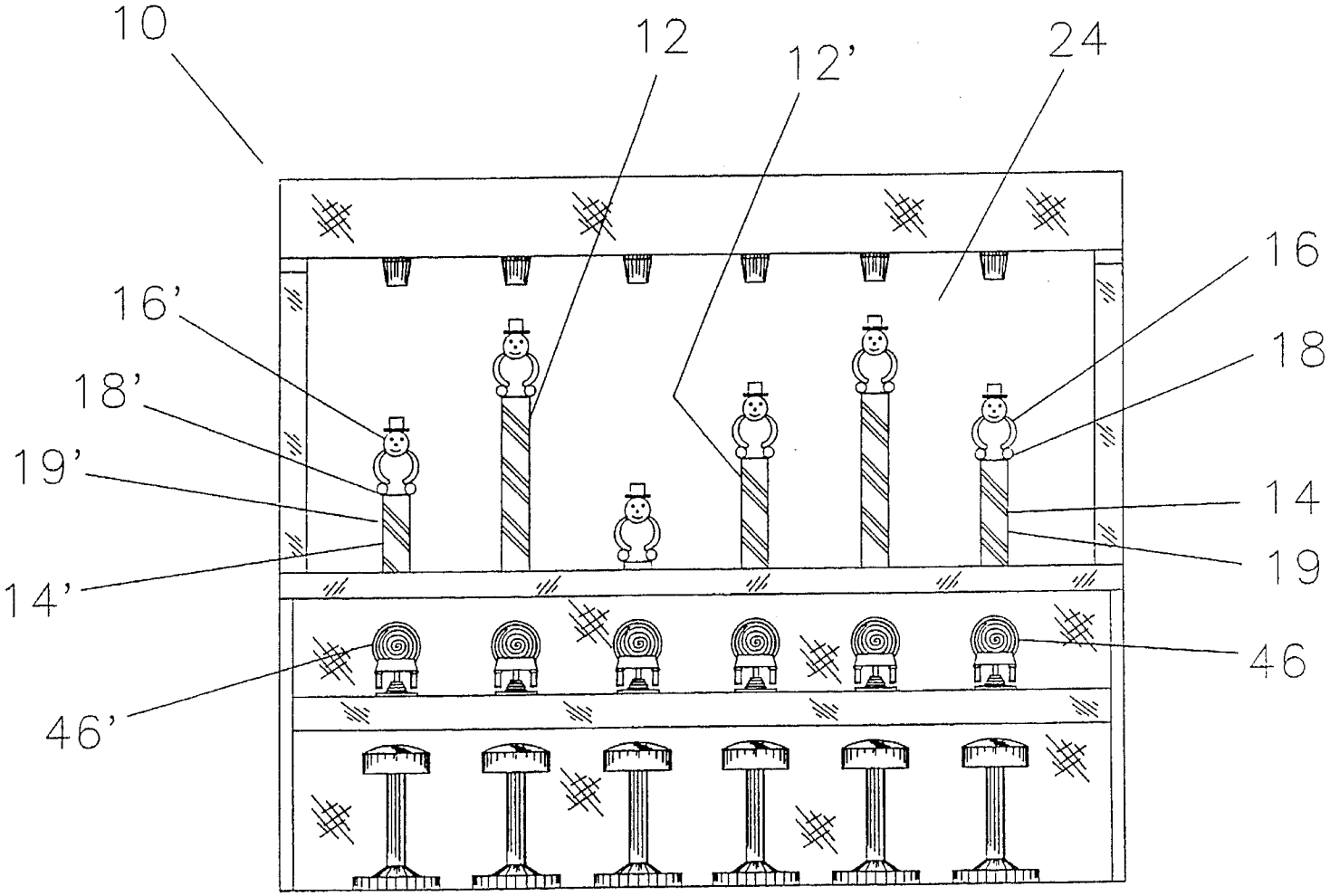
FIG. 9 is a rear elevation view of the double file embodiment of the invention as disclosed in FIG. 7.
Figure 10:
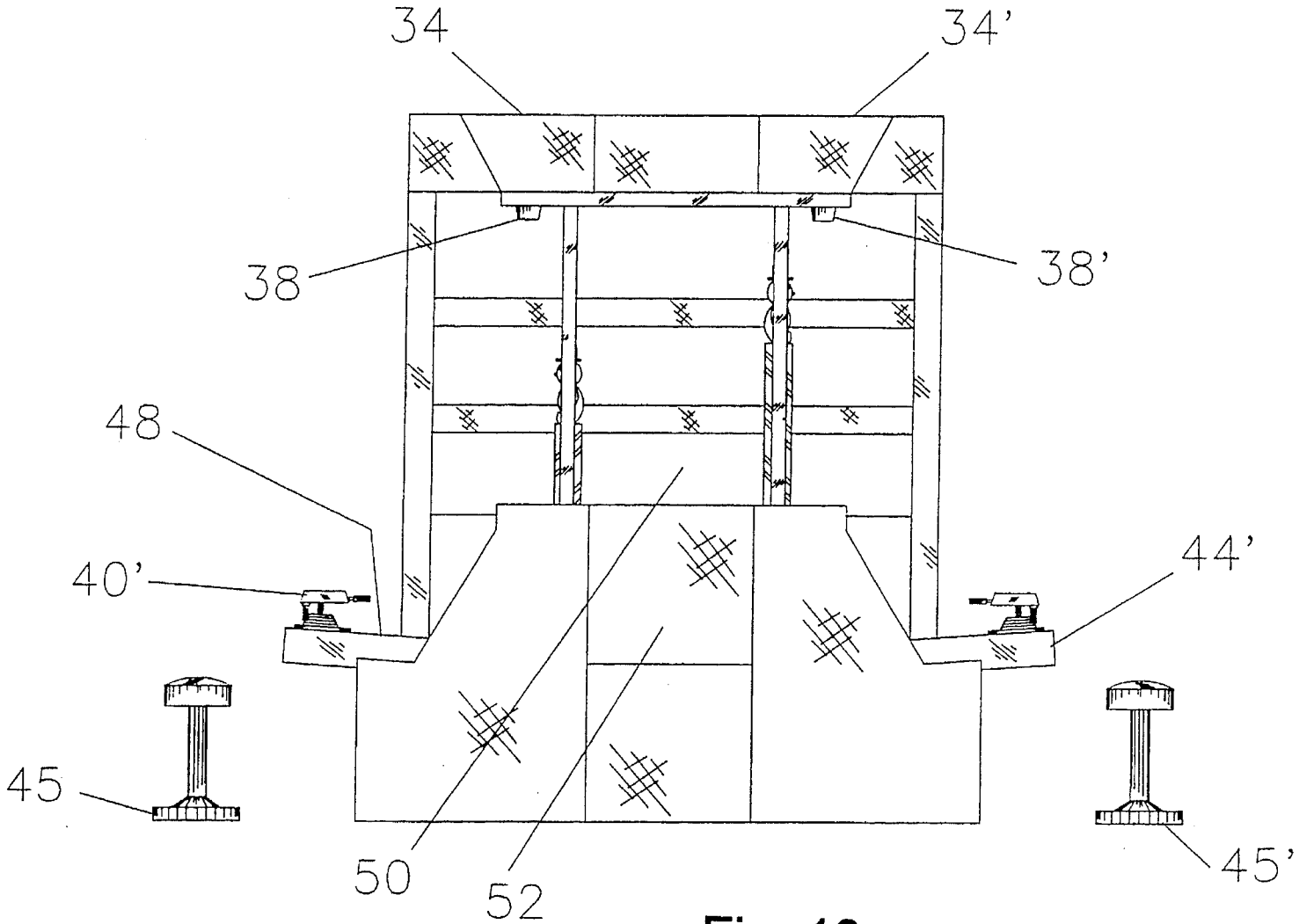
FIG. 10 is a left side view of the invention as disclosed in FIG. 7 and further disclosing the operator access door and walkway disposed therebetween the double file of rotating columns.
Figure 11:
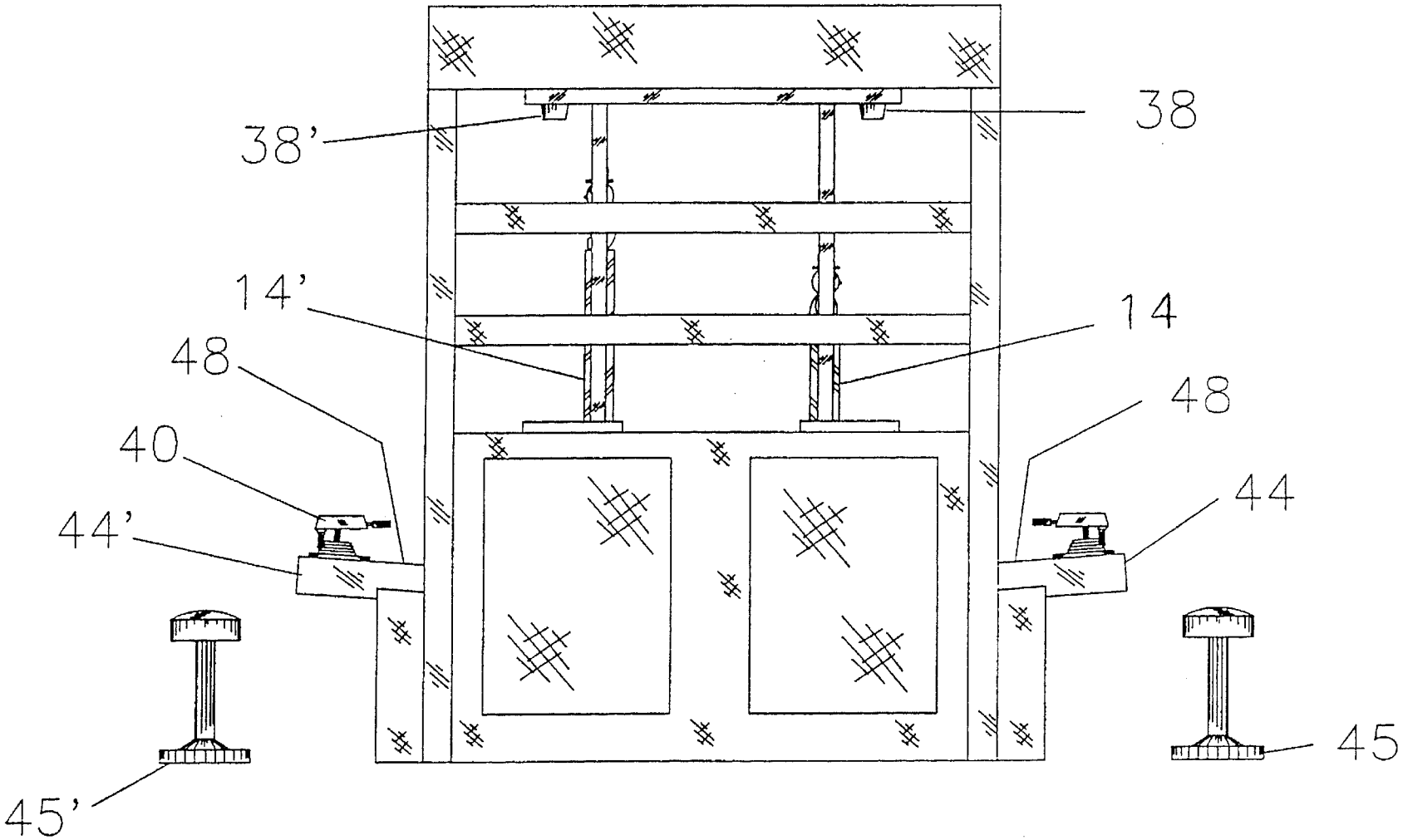
FIG. 11 is a right side view of the invention as disclosed in FIG. 7 and further disclosing the storage and display area for prizes.
Figure 12:
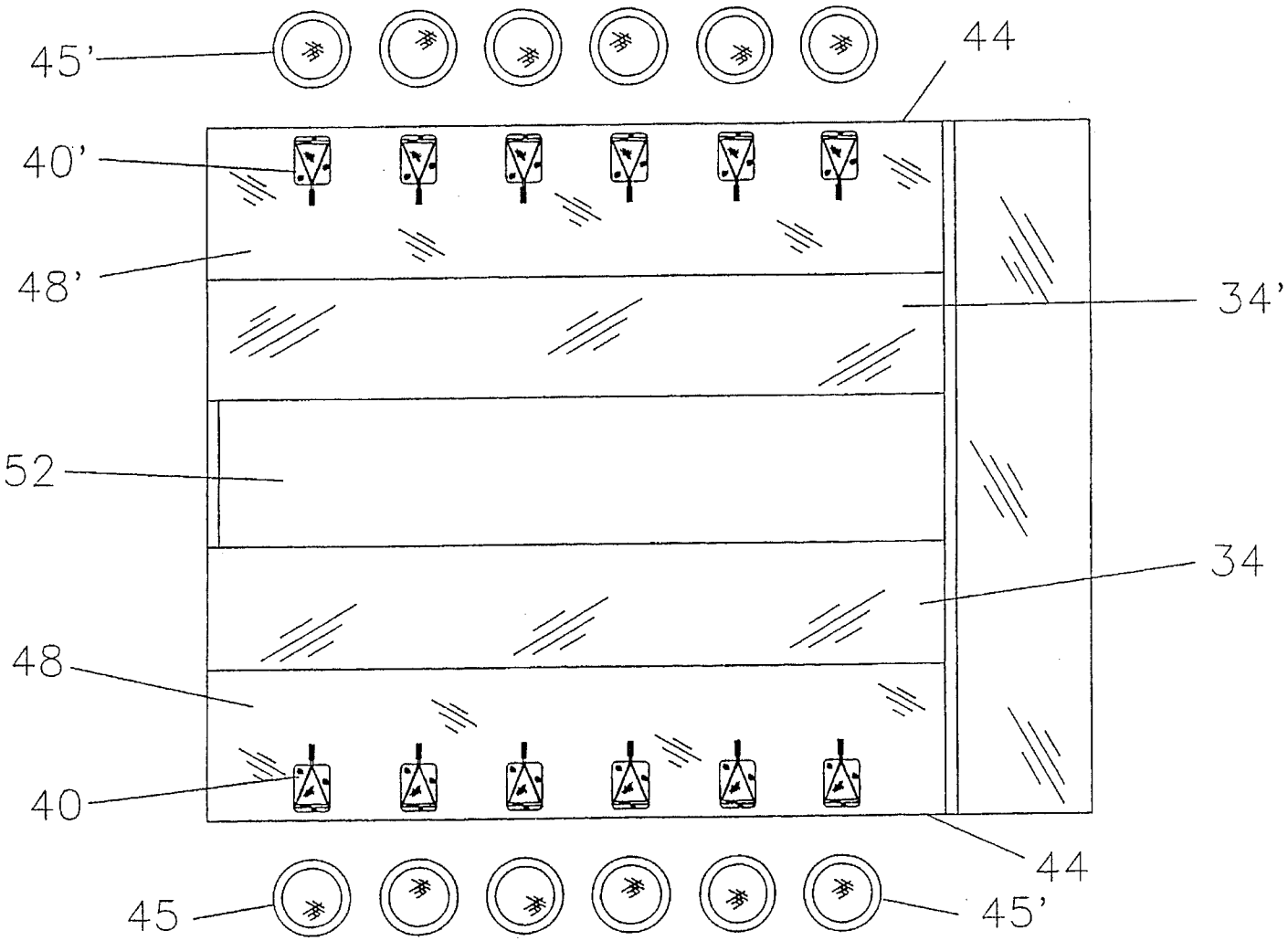
FIG. 12 is a top plan view of the invention as disclosed in FIG. 7 and further disclosing the plurality of actuator elements and seats for the contestants.
Figure 13:
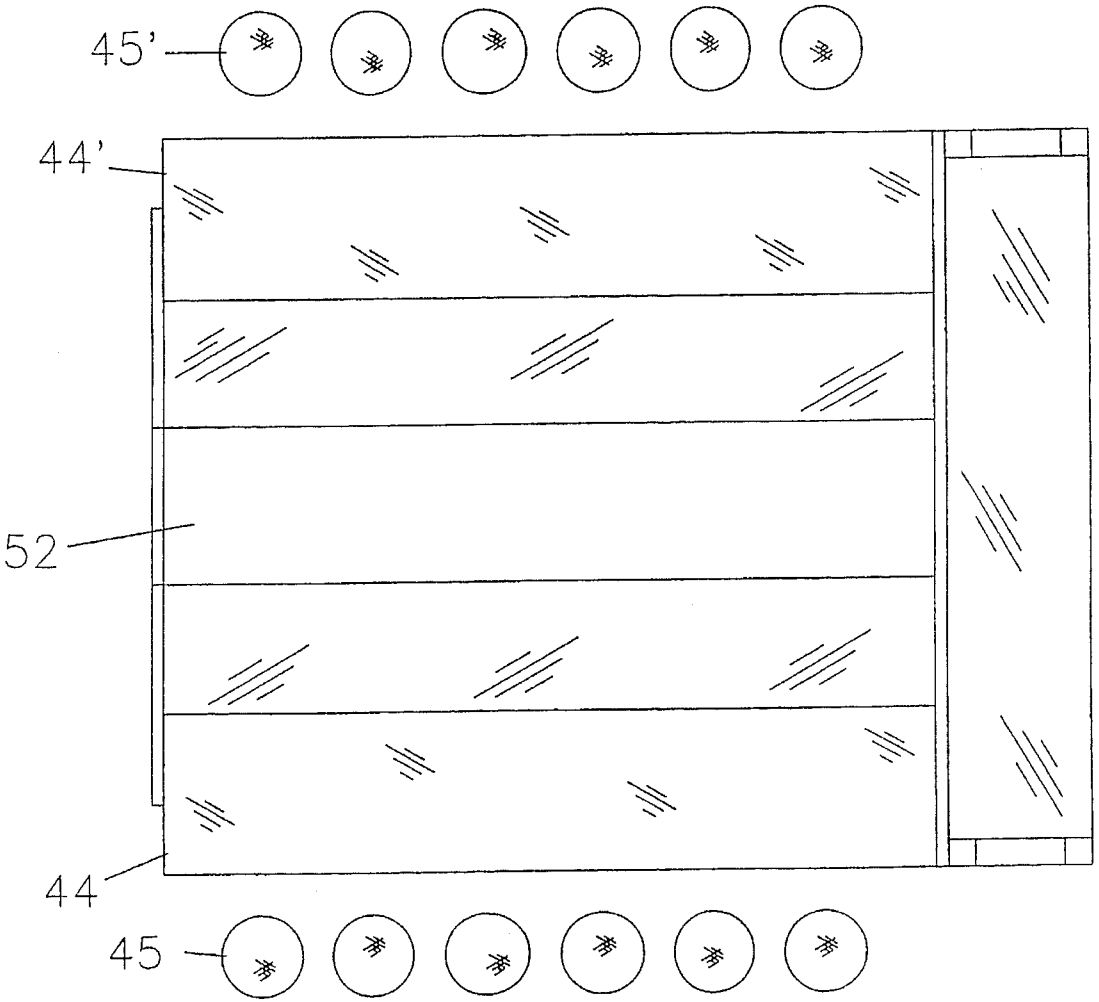
FIG. 13 is a bottom plan view of the invention as disclosed in FIG. 7.
Figure 14:
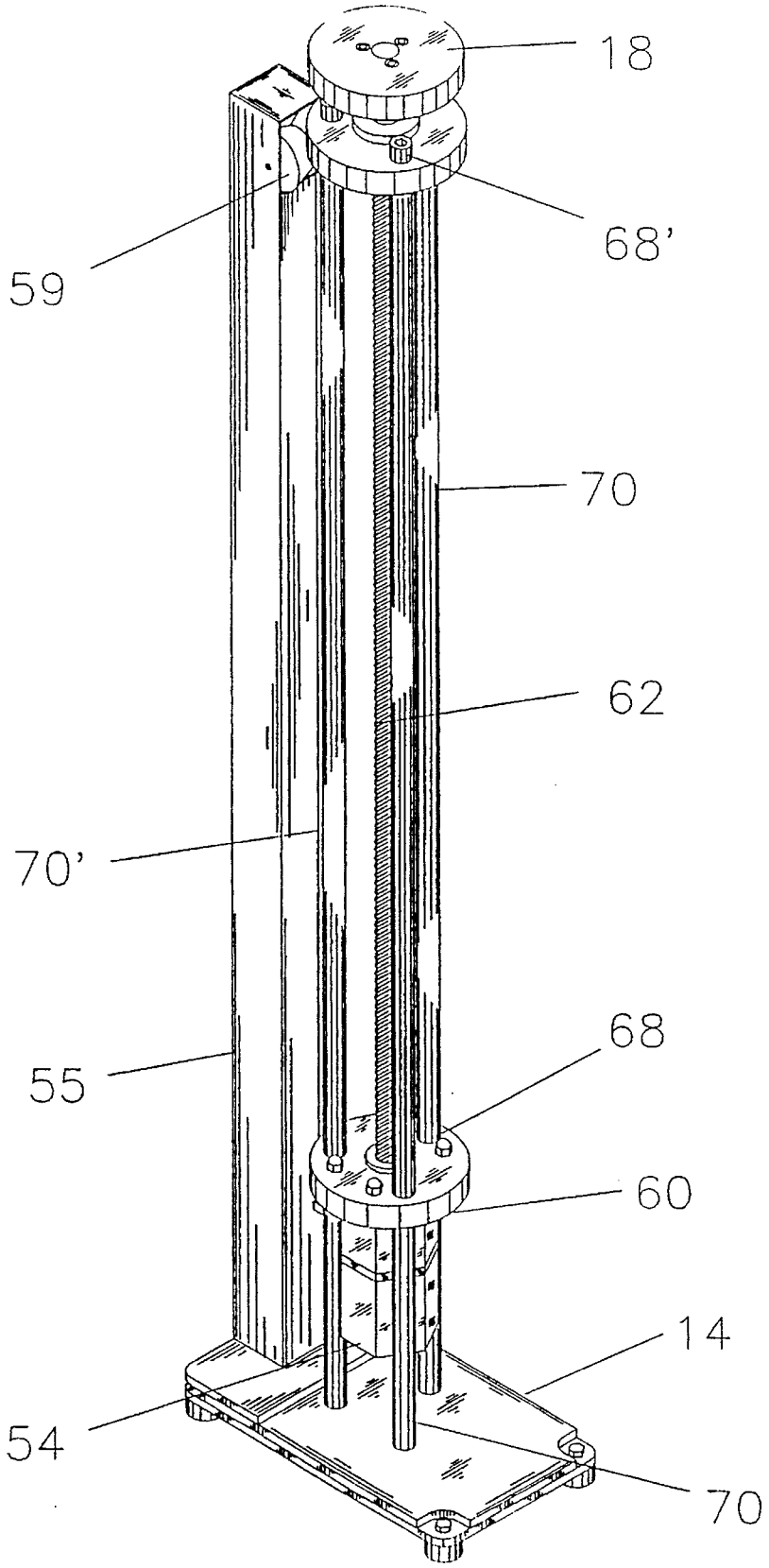
FIG. 14 is a perspective illustration of the interior of the rotatable column and the adjacent housing.
Figure 15:
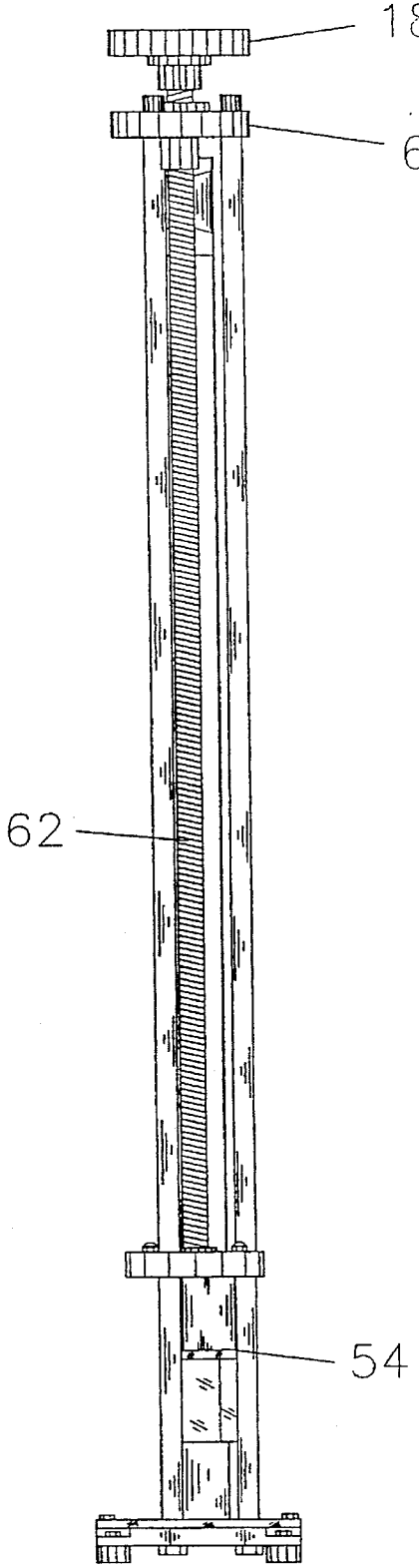
FIG. 15 is a front elevation view of the rotatable column and the housing as disclosed in FIG. 14.
Figure 16:
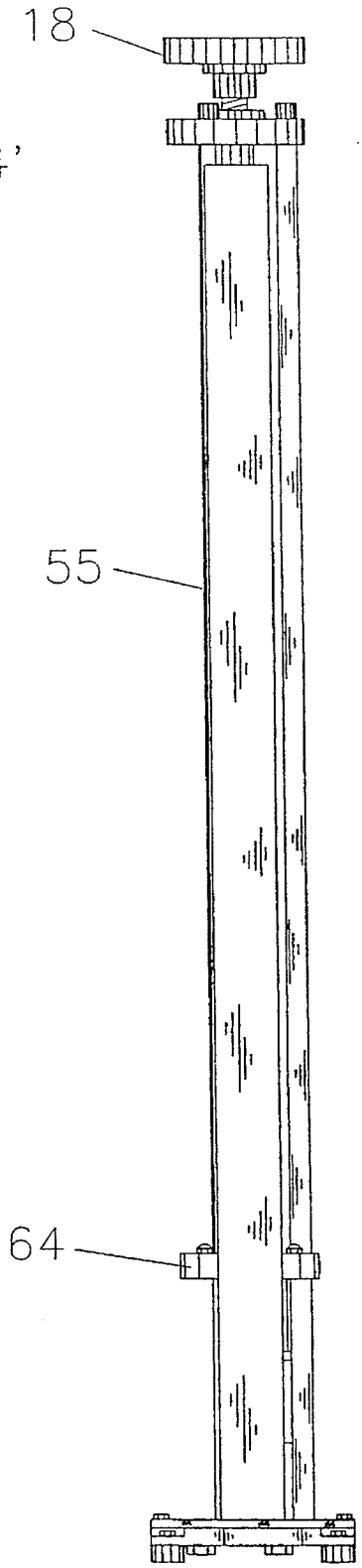
FIG. 16 is a rear elevation view of the rotatable column and housing as disclosed in FIG. 14.
Figure 17:
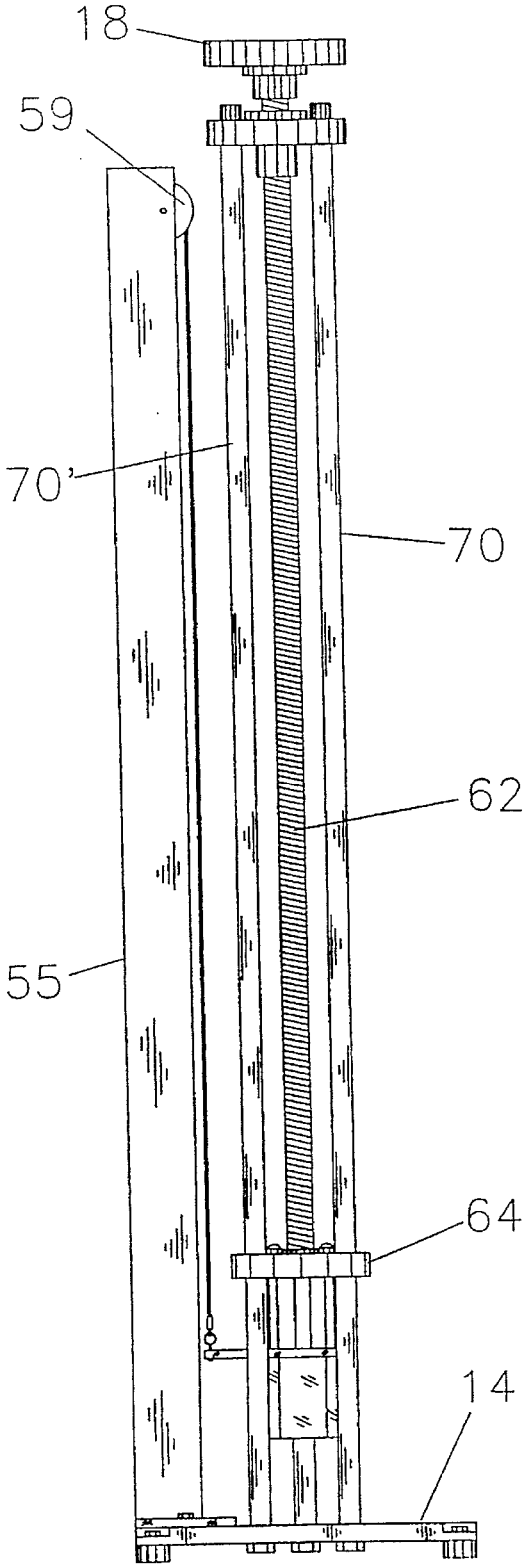
FIG. 17 is a left side view of the rotatable column and housing as disclosed in FIG. 14.
Figure 18:
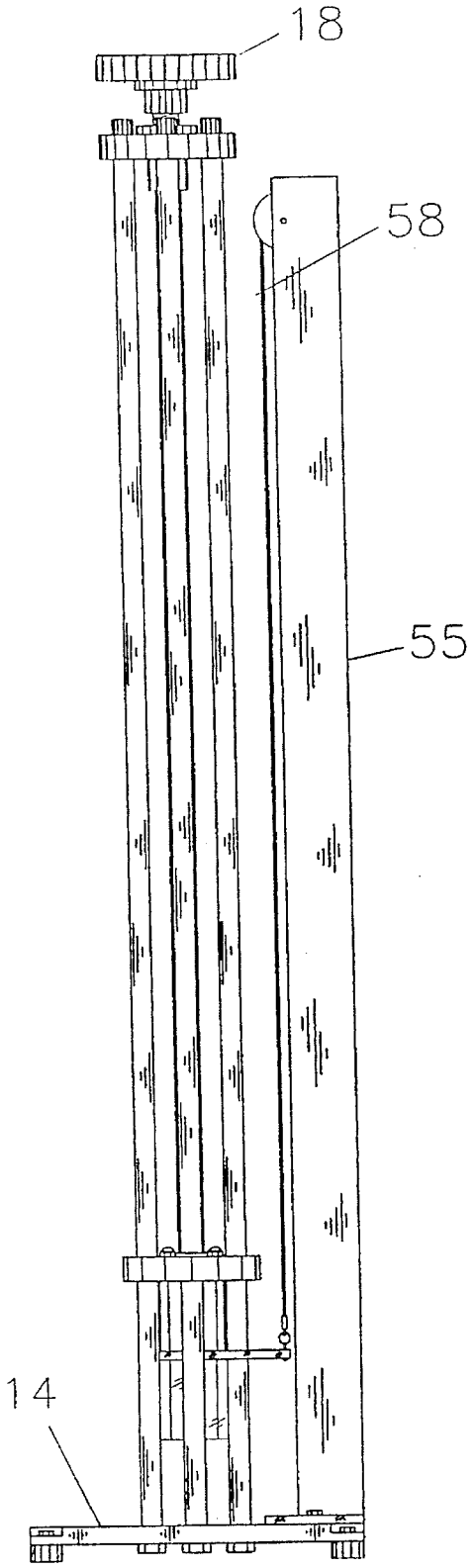
FIG. 18 is a right side view of the rotatable column and housing as disclosed in FIG. 14.
Figure 20:
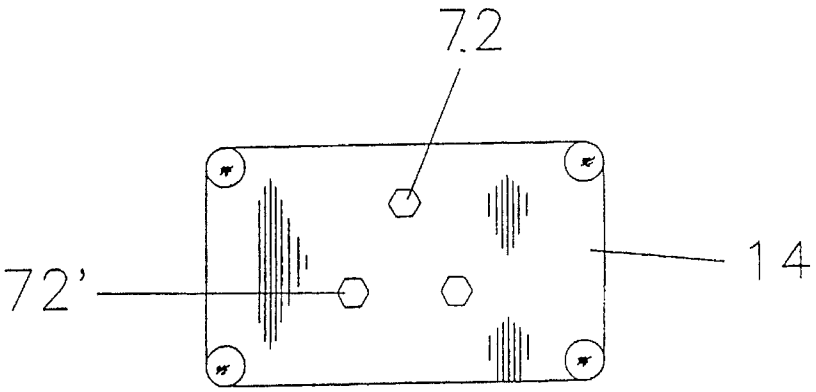
FIG. 20 is a bottom plan view of the rotatable column and housing as disclosed in FIG. 14.
Figure 19:
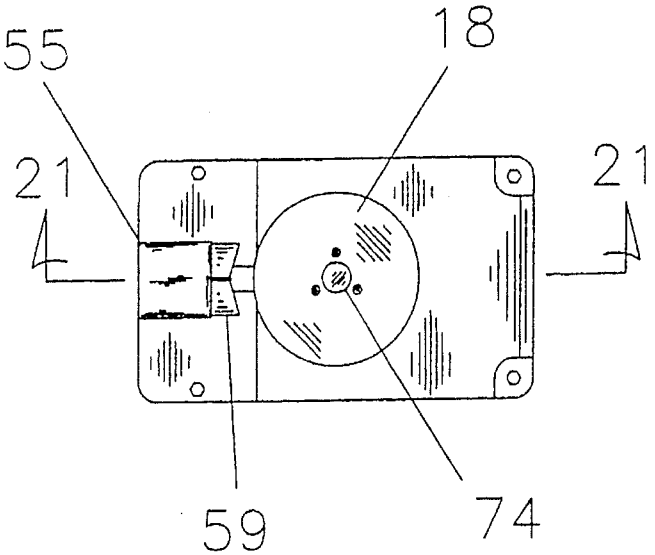
FIG. 19 is a top plan view of the rotatable column and housing as disclosed in FIG. 14.
Figure 21:
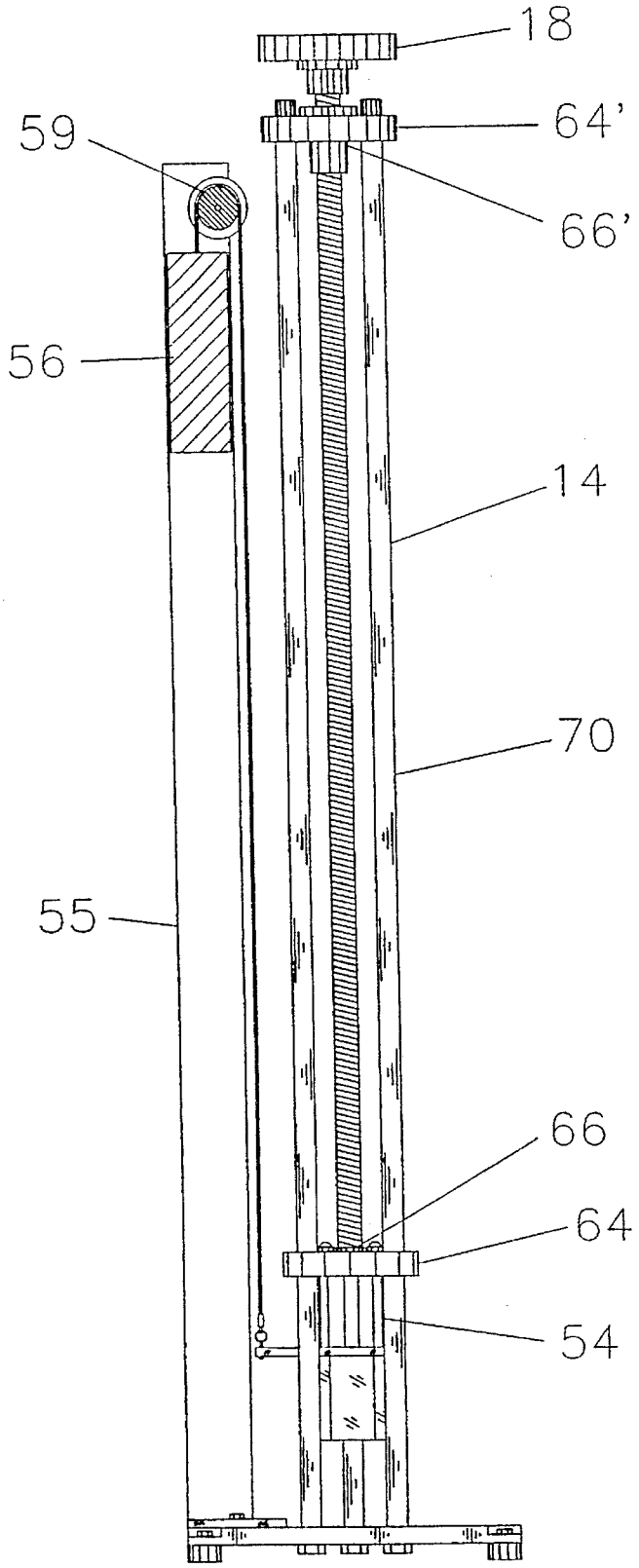
FIG. 21 is a sectional elevation of the rotatable column and housing as disclosed in FIG. 14 disclosing the counterweight in the housing disposed at the beginning of the contest taken along viewing lines 21—21 in FIG. 19.

The number of players can be doubled by aligning two game housings 22, 22' in a back-to-back orientation as best seen in FIG. 7. In this configuration, the operator can monitor the progress of the game by walking in a vertical space 50 on a walkway 52 formed by the two game housings 22, 22'.

In use and operation, the contest starts at the appropriate start signal, the contestants fire rapidly and repeatedly at the target element 46. The person scoring the most frequent hits on the target element 46 will move the figurine 16 upwards towards the finish bumper 38 first, and accordingly, win the prize. When the figurine 16 arrives at the finish bumper 38, it illuminates the winning finish bumper 38 and the figurine 16 winning the particular contest and ends the race.

As best seen in FIG. 2, the preferred embodiment has the water gun 42 and the target element 46 housed on the game console 44. Each game console 44 activates and controls one of the rotatable columns 14 towards the finish bumper 38. A plurality of motor means 54, 54' are disposed in a housing 55 adjacent to the rotatable columns 14, 14'. Each motor means 54 is electrically coupled to one rotatable column 14 and moves one figurine 16 towards the finish bumper 38. Each housing 55 has a counterweight 56 and a continuous cable 58 adjacent the column 14 and in tension communication therewith which urge rotating, smooth, low friction traverse over a pulley 59 upwards towards the finish bumper 38.

Each motor means 54 has a top end 60 adapted for rotating communication with a threaded shaft 62. The shaft 62 is adapted to move upwardly and threadably through a plurality of guide plates 64, 64'. Each guide plate 64 has a threaded aperture 66, 66' centrally disposed therein. A plurality of smooth bore apertures 68, 68' 68" are disposed radially therein. A plurality of guide rods 70, 70', 70" are adapted for frictionless engagement with the smooth bore apertures 68, 68' 68". The guide rods, 70, 70' 70" urge vertical movement of each rotatable column 14 along a longitudinal axis 72 of the guide rods 70, 70', 70". The threaded shaft 62 urges rotational movement of each rotatable column around a second longitudinal axis 74 of the threaded shaft 62.

A plurality of switch means 74, 74' are disposed in each game console 44 therebetween the console 52 and one of the rotatable columns 14. Switch means 74 close the electrical circuits between the motor means 54 and the continuous looped cable 58 for moving the rotatable column 14 when in a closed circuit status and halting the movement of the rotatable column 14 when in an open circuit status.

A second plurality of switch means 76, 76' are disposed in the game housing 22 at each finish bumper 38. The second plurality of switch means 76 is disposed in electric circuit communication with the finish bumpers 38. Second switch means 76 is disposed electrically to illuminate the winning finish bumper 38 when a winning figurine 16 reaches the finish bumper 38.

The balance of the amusement game comprises overhead lighting and artistic interpretations on a back panel that are not novel.

Now that the invention has been described,

What is claimed is:

1. A water activated rotatable column game system for use by people for fun and amusement and prizes comprising in combination:

a game housing having an open rear face and open side faces and an enclosed top roof and an enclosed bottom floor and an open front face for the people to participate in the game and observe the progress of the game;

a plurality of rotatable columns and a plurality of figurines disposed within the game housing in an upstanding orientation, each rotatable column being oriented to travel upwardly from a start line;

a plurality of game consoles disposed adjacent to the game housing and outside the front face, each game console for activating and controlling the upwards travel of one of the rotatable columns;

a plurality of finish bumpers and a plurality of motor means disposed in the game housing and adjacent to the rotatable columns, each motor means being electrically coupled to one rotatable column for moving the rotatable column upwards towards the finish bumper;

a plurality of switch means, each switch means being disposed in one of the game consoles and further being therebetween one of the consoles and one of the rotatable columns for moving the rotatable column upwards towards the finish bumper when in a closed status and halting the rotatable column when in an open status;

a second plurality of switch means, each second switch means being disposed in the finish bumper and for illuminating the winning finish bumper when a winning figurine reaches the finish bumper; and movement means for urging smooth upward rotating movement of the rotatable column.

2. A water activated rotatable column game system for use by people for fun and amusement and prizes as recited in claim 1 wherein each console further includes an aiming device and a target, the aiming device for directing a stream of fluid at the target for urging the rotatable column upwards towards the finish bumper.

3. A water activated rotatable column game system for use by people for fun and amusement and prizes as recited in claim 2 wherein each target is adapted with a recess having a base for receiving the stream, the base being adapted to move rearwardly when the stream hits the base, the base further being in electrical circuit communication with one of the motor means and a microswitch that closes when the base moves a desired distance rearwardly, the base still further having a spring disposed rearward of the base on an exterior side and being biased to return the base to a resting position that opens the microswitch when the stream does not strike the base.

4. A water activated rotatable column game system for use by people for fun and amusement and prizes as recited in claim 3 wherein each recess further includes graphic indicia on an interior side urging the person to direct the stream at the interior face of the base in order to move the rotatable column upwards towards the finish bumper.

5. A water activated rotatable column game system for use by people for fun and amusement and prizes as recited in claim 1 wherein the movement means further includes a threaded shaft, a plurality of guide plates and guide rods, a counter weight, a cable and a pulley disposed in a housing in tension communication with each rotatable column.

6. A water activated rotatable column game system for use by people for fun and amusement and prizes as recited in claim 5 wherein the counterweight is oriented in the housing adjacent the rotatable column, the counterweight being coupled to the rotatable column for guiding the rotatable column upwards.

7. A water activated rotatable column game system for use by people for fun and amusement and prizes as recited in claim 5 wherein the cable is attached to the counterweight, and being in tension communication for urging smooth movement of the counter weight downwardly during the game.

8. A water activated rotatable column game system for use by people for fun and amusement and prizes as recited in claim 1 wherein each rotatable column further include a plurality of stripes obliquely disposed on a surface of the rotatable column for adding visual amusement during the game.

9. A water activated rotatable column game system for use by people for fun and amusement and prizes as recited in claim 1 wherein each rotatable column has a top side adapted to receive one of the figurines.

10. A water activated rotatable column game system for use by people for fun and amusement and prizes as recited in claim 1 wherein the game housing further includes a trailer base oriented below the bottom floor and being attached to the game housing for moving the game housing from place to place.

11. A water activated rotatable column game system for use by people for fun and amusement and prizes as recited in claim 5 wherein the pulley is disposed therebetween the cable and an upper portion of the rotatable column for urging smooth travel over the pulley by the cable.

12. A water activated rotatable column game system for use by people for fun and amusement and prizes as recited in claim 1 wherein the plurality of rotatable columns and figurines are disposed within the game housing in an upstanding orientation and the finish bumpers are disposed downwardly from the top roof in an up-side-down orientation.

13. A water activated rotatable column game system for use by people for fun and amusement and prizes as recited in claim 1 wherein the plurality of consoles are oriented on a common platform.

14. A water activated rotatable column game system for use by people for fun and amusement and prizes as recited in claim 5 wherein the movement means further includes a stepper motor disposed in rigid attachment to a lower portion of the threaded shaft, the guide plates and guide rods thereabove, each guide plate being disposed on an opposite end of the shaft and having an aperture adapted for threadable engagement with the shaft for urging rotating upward travel of the threaded shaft through the apertures when the first switch means is engaged.

15. A water activated rotatable column game system for use by people for fun and amusement and prizes as recited in claim 1 wherein the rotatable columns are disposed in a single colinear vertically oriented plane.

16. A water activated rotatable column game system for use by people for fun and amusement and prizes as recited in claim 1 wherein the rotatable columns are disposed in two coaligned vertical planes for doubling the number of players and having a vertical space therebetween the vertical space for forming an open walkway for use by game personnel to monitor the progress of each game.

17. A water activated rotatable column game system for use by people for fun and amusement and prizes as recited in claim 1 wherein the finish bumper further includes illumination means to indicate the winner of each game.

* * * * *